United States Patent [19]

Escobar et al.

[11] Patent Number: 4,990,883

[45] Date of Patent: Feb. 5, 1991

[54] ACTUATOR WHICH CAN BE LOCKED WHEN EXPOSED TO A HIGH TEMPERATURE

[75] Inventors: Jesus Escobar, Newark; Donald Wilkerson, East Palo Alto, both of Calif.

[73] Assignee: Raychem Corporation, Menlo Park, Calif.

[21] Appl. No.: 364,668

[22] Filed: Jun. 9, 1989

[51] Int. Cl.[5] ..... H01H 37/22; H01H 37/52; H01H 61/08; H01H 71/18

[52] U.S. Cl. ..... 337/357; 337/140

[58] Field of Search ..... 337/140, 356, 357, 358, 337/359, 385, 411, 393, 382, 3, 2, 1, 299; 60/527, 528, 529

[56] References Cited

U.S. PATENT DOCUMENTS 2,114,184 4/1938 Hathaway ..... 337/357

4,568,904 2/1986 Takahashi et al. ..... 337/140

4,679,023 7/1987 Nelson ..... 337/140

*Primary Examiner*—H. Broome

*Attorney, Agent, or Firm*—Herbert G. Burkard

[57] ABSTRACT

An actuator such as an electrical switch which responds to an event such as a change in temperature by movement of an element between first and second positions, for example in which an electrical circuit is open and closed respectively, includes a dimensionally heat-recoverable component which, on recovery when the actuator is exposed to a high temperature, changes configuration so that a portion of the component is positioned between the element while in its first position and a support for the component, so as to restrain movement of the element towards its second position. This allows the actuator to be locked as a result of exposure to the high temperature, which can be desirable, for example, because of damage to equipment to which the actuator is connected.

12 Claims, 3 Drawing Sheets

ACTUATOR WHICH CAN BE LOCKED WHEN EXPOSED TO A HIGH TEMPERATURE

This invention relates to an actuator which responds to an event by changing its configuration. The event may be, for example, electrical, mechanical or thermal in nature. The actuator may be incorporated in, for example, an electrical switch, or a mechanical control system. Examples of actuators include electrical switches which open or close an electrical circuit in response to an event which might simply be mechanical actuation, or which might be in response to a thermal event such as an increase in temperature or to an electrical event as in a relay. Another example of an actuator is a mechanical control device which imparts movement to an object in response to an event; such an actuator might be used, for example to open a valve which might be in chemical process equipment or might simply be a window.

Such actuators generally comprise an element which can move from a first position to a second position in response to the event. In some applications, it can be desirable to restrain movement of the element towards the second position after the actuator has been exposed to a high temperature, for example because of damage to equipment connected to the actuator resulting from exposure to that high temperature.

The present invention provides an actuator which can be locked when exposed to a high temperature, which comprises:

(a) a support;

(b) an element which can move from a first position to a second position in a direction towards the support in response to an event; and (c) a dimensionally heat-recoverable component which, when heated to cause it to recover, adopts a configuration in which it can contact the element while in or near to its first position and be supported by the support so as to be able to restrain movement of the element towards its second position.

The component is dimensionally heat-recoverable in the sense that its dimensional configuration may be made to change significantly when it is heated. Its heat-recoverability may be derived from the use of a shape memory alloy. Shape memory alloys exhibit a shape memory effect as a result of their ability to transform between martensitic and austenitic phases. The transformation may be caused by a change in temperature: for example, a shape memory alloy in the martensitic phase will begin to transform to the austenitic phase when its temperature increases to a temperature greater than $A_s$, and the transformation will be complete when the temperature is greater than $A_f$. The reverse transformation will begin when the temperature of the alloy is decreased to a temperature less than $M_s$ and will be complete when the temperature is less than $M_f$. The $M_s$, $M_f$, $A_s$ and $A_f$ temperatures of a shape memory alloy define the thermal transformation hysteresis loop of the alloy. An article formed from a shape memory alloy may be formed in a desired configuration while the alloy is in its austenitic phase. If the article is then cooled so that the alloy transforms to the martensitic phase, it can then be deformed so as to obtain a strain on recovery of up to about 8%. The strain imparted to the article is recovered when it is subsequently heated so that it transforms back to the austenitic phase. Further information is available in an article by L. M. Schetky in Scientific American, Volume 241, pages 68 to 76 (1979) entitled Shape Memory Alloys.

The alloy will be selected such that it begins to transform from its martensitic phase to its austenitic phase at the temperature at which it is wished to lock the actuator. This temperature may be selected according to the potential for damage to equipment connected to the actuator as a result of exposure to the high temperature. The $A_s$ temperature may be selected by varying the composition of the shape memory alloy, or the manner in which it is processed, or both, according to known techniques.

Alternatively (or in addition), the heat-recoverability of the component may be derived from the use of a heat-recoverable polymeric material The property of heat-recoverability may be imparted to an article, formed from a polymeric material in a desired shape, by crosslinking the material chemically or by irradiation, heating the article to soften the polymeric material, deforming the article, and locking the article in its deformed configuration by cooling it. The deformed article will retain its shape until it is exposed to a temperature above its crystalline melting temperature, when it will attempt to recover to the shape it had when it was crosslinked.

The actuator of the present invention has the significant advantage that it can maintain the actuator in a locked state over a wide range of temperatures. The range of temperatures is not restricted significantly by the fact that heat recoverable materials can be deformed relatively easily (as is done to render them recoverable) at certain temperatures, because of the support for the component against the force exerted by the element as it attempts to move towards its second position. It is therefore necessary only that that part of the component between the element and the support is sufficiently rigid to restrain movement of the element.

When the component is formed from a shape memory alloy, the actuator can be used after it has been cooled below the high temperature, even to temperatures below the $M_s$ temperature of the alloy, when the alloy is relatively weak and could be deformed by the element as it moves towards its second position. This is possible because, when the component recovers, a part of it is supported by the support.

When the component is formed from a polymeric material that is used for its heat-recoverability, it can maintain the actuator in its locked state at temperatures above the glass transition temperature of the material, when the material is relatively weak and could be deformed by the element as it attempts to move towards its second position In this situation, it might be desirable to form just the part of the component that is acted on by the element and the support from a material that is sufficiently rigid that it can restrain movement of the element.

The support provides support for the component after it has recovered against force exerted on it by the element as it attempts to move from the first position towards the second position Preferably it will be a mechanical stop, and the component will recover towards a configuration in which at least part of it is located between the element (while in its first position) and the support so that it is compressed by the element as it attempts to move towards its second position. The support may however take other forms, such as a detent in which the component is partially received after recovery.

The element may move along an axis between the first and second positions; for example it may be axially extendable as in the case of a helical spring.

Preferably, the element moves in a plane between the first and second positions. For example, it may be mounted pivotally so that it can rotate between the first and second positions. Alternatively, the element may be flexible and be moved between the first and second positions by being flexed.

Preferably, the element is less stable at a point between the first and second positions than it is in each of the first and second positions. This allows the element to move between the first and second positions quickly, as with a snap action, irrespective of the speed with which the event takes place. This can be important in a number of applications, for example when the actuator is used in an electrical switch when a snap action can minimize sparking between contacts as they open or close.

The event, in response to which the element moves between the first and second positions, may be a thermal event, as might be the case, for example, when the actuator forms a part of a thermostat for opening and closing an electrical circuit, or for opening and closing a window. The element may be formed from a bimetal strip, which may be appropriately biased to make it more stable in its first and second positions than in a position between the two. The element may also be formed at least partly from a shape memory alloy and might also be so biased. The shape memory alloy may be capable of transforming reversibly between two configurations in the austenitic and martensitic phases respectively, or the element may include a reset spring by which it is deformed when it its martensitic phase.

The event may be a mechanical event which might be brought about directly or indirectly by the intervention of an operator. For example, the actuator may be such that an operator moves the element between the first and second positions manually, possibly by means of a lever that is connected to the element.

The event may be an electrical event, such as a surge of current or of voltage, or as in a relay.

Generally, for ease of manufacture, the component will be made entirely from a heat-recoverable polymeric material or, more preferably, from a shape memory alloy, but for some applications, it may be advantageous to use a component which is formed partly from a shape memory alloy or a heat-recoverable polymeric material (to provide a recovery force when the component is heated) and partly from another material through which, for example, the component is mounted, or is acted on by the support.

Important characteristics of the component are that its recovery temperature be greater than any temperature encountered in normal use and less than that at which it is desired to cause the actuator to lock, and sufficient resistance to compression of that part of the component that is acted on by the element and the support.

The shape memory alloy, when used, will therefore be selected according to the temperature to which the component formed from it will be exposed before, during and after installation, and to the physical requirements placed on it when in use. The alloy may be based on copper, for example as disclosed in U.S. Pat. No. 4144057 or U.S. Pat. No. 4144104, or more preferably on nickel-titanium, which may contain quantities of a third material, for example as disclosed in U.S. Pat. No. 3753700, U.S. 4337090, U.S. Pat. No. 4565589 or U.S. Pat. No. 4770725. A preferred method of treatment of a nickel-titanium based shape memory alloy is disclosed in U.S. Pat. No. 4740253. The subject matter disclosed in these documents is incorporated herein by these references to the documents.

In one embodiment, the component is formed from a shape memory alloy wire and is generally U-shaped. The two legs of the U move relative to one another when the component recovers. For example, the element, the support and one of the legs of a U-shaped component may be mounted on a base while the other of the legs of the component can move relative to the base. The actuator may be locked by heating the component to cause the movable leg to move relative to the base so that it becomes positioned between the element and the support, restraining movement of the element towards the support. The legs of the U preferably move towards one another when the component recovers.

In another embodiment, the part of the component that is located between the element and the support, in the form of a mechanical stop, has a long transverse dimension and a short transverse dimension. On recovery of the component, the said part of the component rotates. For example, the part of the component which is located between the element and the stop may be stamped from a sheet, for example of metal, and may be arranged so that, before recovery, it presents its principal surfaces to the element and the stop respectively, and so that it rotates through 90° on recovery so that the edges of the sheet are in contact with the element and the stop respectively. The part of the component which recovers when heated may be made from a polymeric material such as crosslinked polyethylene, or from a shape memory alloy.

Alternatively, the component may be formed from wire in the shape of a T or an inverted L, in which the arms of the T or the L are approximately perpendicular to the direction of movement of the element before recovery, and approximately parallel to the direction of movement of the element after recovery.

In yet another embodiment, the component changes its configuration from one in which it is relatively straight to one in which it is L-shaped, in a bending deformation.

Embodiments of the present invention will now be described by way of example with reference to the accompanying drawings, in which.

Figure 1A:
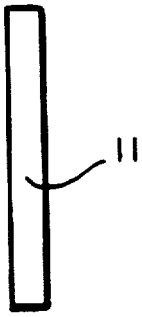
FIGS. 1 to 3 are plan views of a first embodiment of electrical switch, with accompanying side views of the heat-recoverable component thereof.

Referring to the drawings, FIG. 1*a* shows a heat-recoverable component in the form of a metal strip which comprises 50.6 atomic percent titanium and 49.4 atomic percent nickel. The strip is 17.1 mm long, 1.9 mm wide and 0.5 mm thick, and was formed by a combination of hot rolling and cold rolling. The strip was twisted through 90° at about its midpoint and annealed while held in its twisted configuration at 450° C., at which temperature, the alloy is in its austenitic phase for about 30 minutes. After cooling to room temperature, at which the alloy is in its martensitic phase, the twist was removed.

Figure 3A:
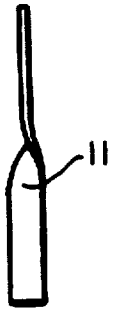

When exposed to a temperature above 90° C., the $A_s$ temperature of the alloy, the component reverts to its twisted configuration as shown in FIG. 3*a*.

Figure 1B:
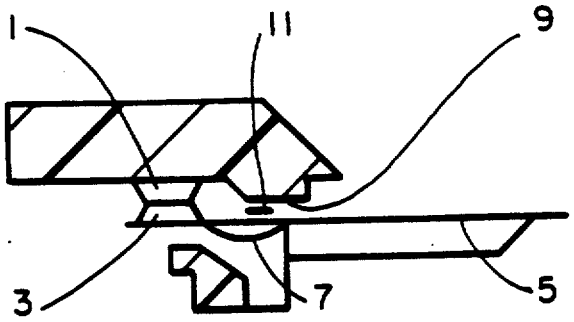

FIG. 1*b* shows an electrical switch which comprises a fixed contact 1 and a movable contact 3 mounted on a flexible arm 5. The movable contact 3 and the arm 5 move between a first position in which the circuit is open and a second position in which the contacts touch one another and the circuit is closed. The arm 5 is formed form a bimetal strip so that the movable contact 3 moves between the first and second positions in response to changes in ambient temperature, the arm being so arranged that the circuit is open at higher temperatures and is closed at lower temperatures. A spring 7 ensures that the contact 3 and the arm 5 are move stable in the first and second positions than in a position between the two.

The switch includes a support for the component (when reversed) in the form of a mechanical stop 9 and the heat-recoverable component 11 described above with reference to FIG. 1*a*. The heat-recoverable component is located between the arm 5 and the stop 9. The component is so mounted that its principal surfaces face the arm 5 and the stop 9 respectively.

Figure 2A:
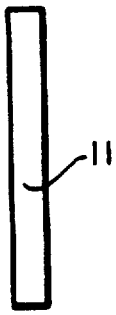
Figure 2B:
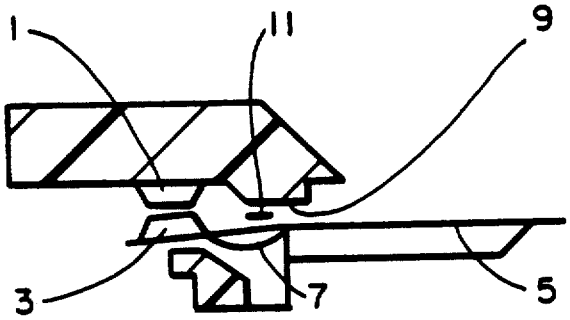

FIGS. 1*b* and 2*b* show the switch in the closed and open circuit conditions respectively, but at a temperature below 90° C. at which the component 11 tends to recover towards its twisted configuration.

Figure 3B:
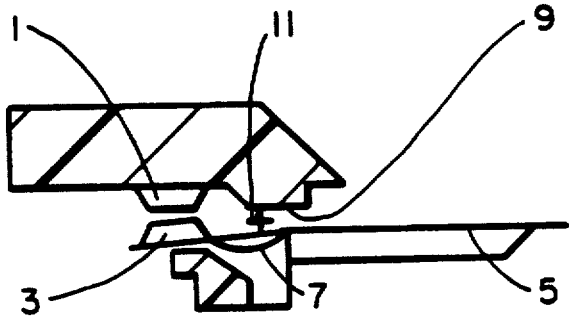

FIG. 3*b* shows the switch after it has been exposed to a temperature greater than 90° C., at which the component 11 has recovered to its twisted configuration so that the arm 5 is prevented from moving towards its second position by the twisted portion of the component. The arm is prevented from so moving across a wide range of temperature, including temperatures below the $M_s$ temperature of the alloy at which the alloy is in its martensitic phase, provided that the resistance of the component to compression is greater than the force exerted on it by the arm.

Figure 4A:
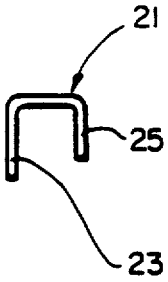
FIGS. 4 to 6 are plan views of a second embodiment of electrical switch, with accompanying side views of the heat-recoverable component thereof.

FIG. 4*a* shows a U-shaped heat-recoverable component 21 formed from a wire (diameter 1 mm) of the nickel titanium alloy from which the component illustrated in FIG. 1 was formed. The component has a longer fixed leg 23 and a shorter movable leg 25. After cooling, the legs were moved apart.

Figure 4B:
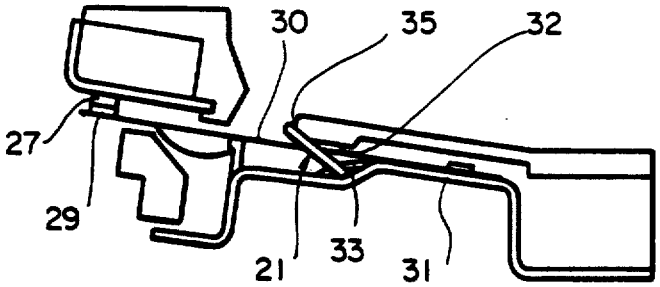

FIG. 4*b* shows an electrical switch comprises a fixed contact 27 and a movable contact 29 mounted on an arm 30 formed from a shape memory alloy. The arm is attached rigidly at one end to a support 31, and is so arranged that the circuit is open at higher temperatures and closed at lower temperatures.

The switch includes a support for the component (when recovered) in the form of a mechanical stop 32. The component 21 is positioned with its fixed leg 23 attached to a support 33 and its movable leg 25 beyond the end 35 of the stop 32.

Figure 5A:
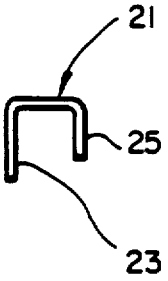
Figure 5B:
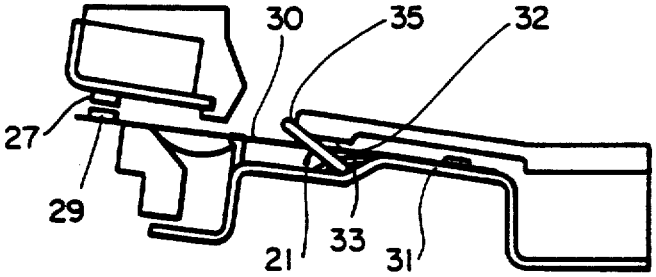

FIGS. 4*b* and 5*b* show the switch in the closed and open circuit conditions respectively but at a temperature below 90° C. at which the legs of the component move towards one another as its recovers.

Figure 6A:
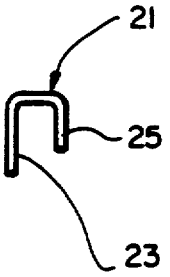
Figure 6B:
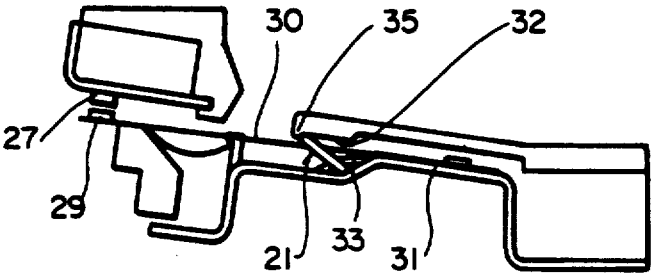

FIG. 6*b* shows the switch after it has been exposed to a temperature greater than 90° C., at which the component 21 has recoverd so that the movable leg 25 is positioned between the arm 30 and the stop 32, preventing the arm from moving towards its second position.

Rather than being attached to the support rigidly at one end, the arm 30 may be mounted pivotally on the support, and acted on mechanically, for example, by a lever, or electrically by, for example, an electromagnetic device.

Figure 7A:
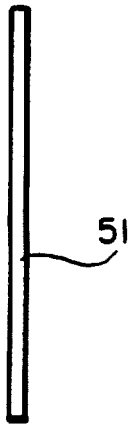
FIG. 7 is a view of a heat-recoverable component suitable for use in a third embodiment of electrical switch.
Figure 7B:
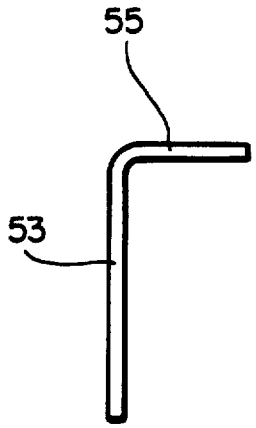

FIG. 7 illustrates an alternative configuration, as shown in FIG. 7*b*, in which the heat-recoverable component described above with reference to FIG. 1 may be annealed, and towards which it can recover from being essentially straight, as shown in FIG. 7*a*, when heated. In the alternative configuration, the component 51 has the shape of an inverted L. The component has a longer leg 53 through which it is mounted, and a shorter leg 55 which extends between the element and the stop of an actuator once the actuator has been exposed to a temperature which is so high that the component recovers from its straight configuration to the L-shaped configuration.

The component 51 may be made from a polymeric material, although it may be necessary to reinforce at least the shorter leg 55 to prevent it from buckling under the force exerted by the element. In this case, the component is formed, for example by moulding, in the L-shaped configuration, and is straightened while heated to a temperature greater the crystalline melt temperature of the polymeric material.

What is claimed is:

1. An electrical switch having at least three positions:
(i) an open switch position;
(ii) a closed switch position; and
(iii) a locked open switch position;
said switch comprising:
(a) a first electrical contact;
(b) a support member;
(c) a moveable arm element comprising a second electrical contact, which second contact is moveable from said open switch position to said closed switch position in response to an event; and
(d) a component comprising heat-recoverable shape memory alloy having an initial austenitic phase transformation temperature $A_s$, at least a part of which component, on its first exposure to a temperature above $A_s$, moves to a position such that said component is interposed between said support member and said element whereby said switch is fixed in the locked open switch position even on subsequent exposure to temperatures below $A_s$.

2. A switch in accordance with claim 1, wherein said shape memory alloy is a nickel titanium alloy.

3. A switch as claimed in claim 1, in which the element moves in a plane between the open switch position and the closed switch position.

4. A switch as claimed in claim 3, in which the element is mounted pivotally so that it can rotate between the open switch position and the closed switch position.

5. A switch as claimed in claim 3, in which the element is flexible and is moved between the open switch position and the closed switch position by being flexed.

6. A switch as claimed in claim 1 in which the component is formed from a single material.

7. A switch as claimed in claim 1, in which the element is less stable at a point between the open switch position and the closed switch position than it is in each of the open switch position and the closed switch positions.

8. A switch as claimed in claim 1, in which the element moves between the first and second positions in response to an electrical event.

9. A switch as claimed in claim 1, in which the component is generally U-shaped, and in which the legs of the U move relative to one another when the component recovers.

10. A switch as claimed in claim 1, in which the component has a long transverse dimension and a short transverse dimension, and in which, on recovery of the component, a part thereof rotates to a position between the element and a stop.

11. A switch as claimed in claim 1, in which the component changes its configuration on heating from a configuration in which it is relatively straight to one in which it is I-shaped.

12. A switch as claimed in claim 1, in which the first contact is affixed to the support member.

* * * * *